US005105570A

United States Patent [19]

Lishness et al.

[11] Patent Number: 5,105,570

[45] Date of Patent: Apr. 21, 1992

[54] FIRING PIN SPRING ASSEMBLY

[75] Inventors: Bryant L. Lishness, Bristol; Paul A. Scirica, East Hampton, both of Conn.

[73] Assignee: Colt's Manufacturing Company Inc., West Hartford, Conn.

[21] Appl. No.: 628,383

[22] Filed: Dec. 14, 1990

[51] Int. Cl.[5] ..... F41A 19/27

[52] U.S. Cl. ..... 42/69.01; 267/169

[58] Field of Search ..... 42/69.01, 69.02, 41, 42/42.01, 42.02; 89/132, 139, 141, 143, 145, 148, 149, 150, 154

[56] References Cited

U.S. PATENT DOCUMENTS

| | | | |
|---|---|---|---|
| 1,358,104 | 11/1920 | Payne | 42/69.02 |
| 1,395,455 | 11/1921 | Searle | 42/69.02 |
| 1,427,966 | 9/1922 | Nickl | 89/163 |
| 2,890,626 | 6/1959 | Amsler | 89/180 |
| 3,678,800 | 7/1972 | Seidel et al. | 89/147 |
| 3,857,325 | 12/1974 | Thomas | 89/138 |
| 4,031,648 | 6/1977 | Thomas | 42/70.01 |
| 4,203,348 | 5/1980 | Sokolovsky | 89/148 |
| 4,646,619 | 3/1987 | Sokolovsky | 89/145 |
| 4,703,826 | 11/1987 | Byron | 89/188 |
| 4,825,744 | 5/1989 | Glock | 89/145 |

*Primary Examiner*—Michael J. Carone
*Attorney, Agent, or Firm*—Perman & Green

[57] ABSTRACT

A spring assembly for use in a firing pin assembly of a firearm and a method of manufacturing the spring assembly. The spring assembly has two spring guides with longitudinal slots. One of the guides has a side aperture such that the two guides can be connected to each other with portions of the guides located in the other guide's slot. A spring is located between portions of the two guides. The guides can move relative to each other with a limited range of motion in a substantially linear path and the spring can bias the guides back to an extended position.

20 Claims, 1 Drawing Sheet

FIRING PIN SPRING ASSEMBLY

BACKGROUND OF THE INVENTION

1. Field of the Invention

The present invention relates to spring assemblies and, more particularly, to a spring assembly for use in a firearm.

2. Prior Art

There are various different types of firearms known in the prior art. There are also various different types of springs and spring assemblies used in these prior art firearms. One type of prior art spring assembly uses two elongate coaxial members that have a coil spring between and around portions thereof and, that can move relative to each other. The spring biases the members in an extended position relative to each other, but can be compressed by telescopic type movement of the members relative to each other. A pin is inserted between portions of the two members to limit relative extension between the members.

A problem exists with prior art spring assemblies in that the assemblies are difficult to assemble and disassemble. This increases costs in the manufacture and repair of the firearm. It is especially difficult to properly insert and remove a movement limiter pin between the members without damage to the coil spring around the members.

A further problem exists with prior art spring assemblies in that they are made entirely from metal which increases the weight of the firearm.

It is therefore an objective of the present invention to provide a new and improved spring assembly for use with a firearm and a simplified method of manufacturing the assembly.

SUMMARY OF THE INVENTION

The foregoing problems are overcome and other advantages are provided by a new and improved spring assembly for use in a firearm and a method of manufacturing the same.

In accordance with one embodiment of the present invention, a firing pin assembly is provided comprising a firing pin and a spring assembly adapted to move the firing pin. The spring assembly has a spring, a front spring guide, and a rear spring guide. The firing pin is connected to the front spring guide for at least partial movement therewith. The spring is positioned between portions of the front and rear spring guides to bias the guides in a first extended position. The front and rear spring guides are movably connected to each other in general telescopic fashion and each have a longitudinal slot therein. A forward portion of the rear spring guide is located in the front spring guide slot and a rearward portion of the front spring guide is located in the rear spring guide slot wherein the front and rear portions can prevent the guides from being pushed apart by the spring.

In accordance with one method of the present invention, a method of manufacturing a firing pin spring assembly is provided. The method comprises the steps of providing a first spring guide, a second spring guide, and a spring. The spring guides each have a longitudinal slot therein and at least one of the spring guides has a lateral opening to its slot. The method further comprises positioning the spring on the first spring guide and, inserting a portion of the first spring guide into the second spring guide slot and a portion of the second spring guide into the first spring guide slot such that the portions can interfere with each other to allow limited movement of the first and second guides relative to each other.

In accordance with another embodiment of the present invention, a spring assembly for use in a firearm to move a firing pin is provided. The spring assembly comprises a first spring guide, a second spring guide, and a spring located between portions of the first and second guides. The first spring guide has a unitary member with a substantially enclosed longitudinal slot therein. The second spring guide has a unitary member with an enclosed longitudinal slot therein. The assembly further comprises means for moving the guides relative to each other in a linear path which comprises the slots being substantially longitudinally coaxially positioned relative to each other and orientated transverse with each other and, portions of the guides being located in the other guide slot to allow for a limited relative movement therebetween.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
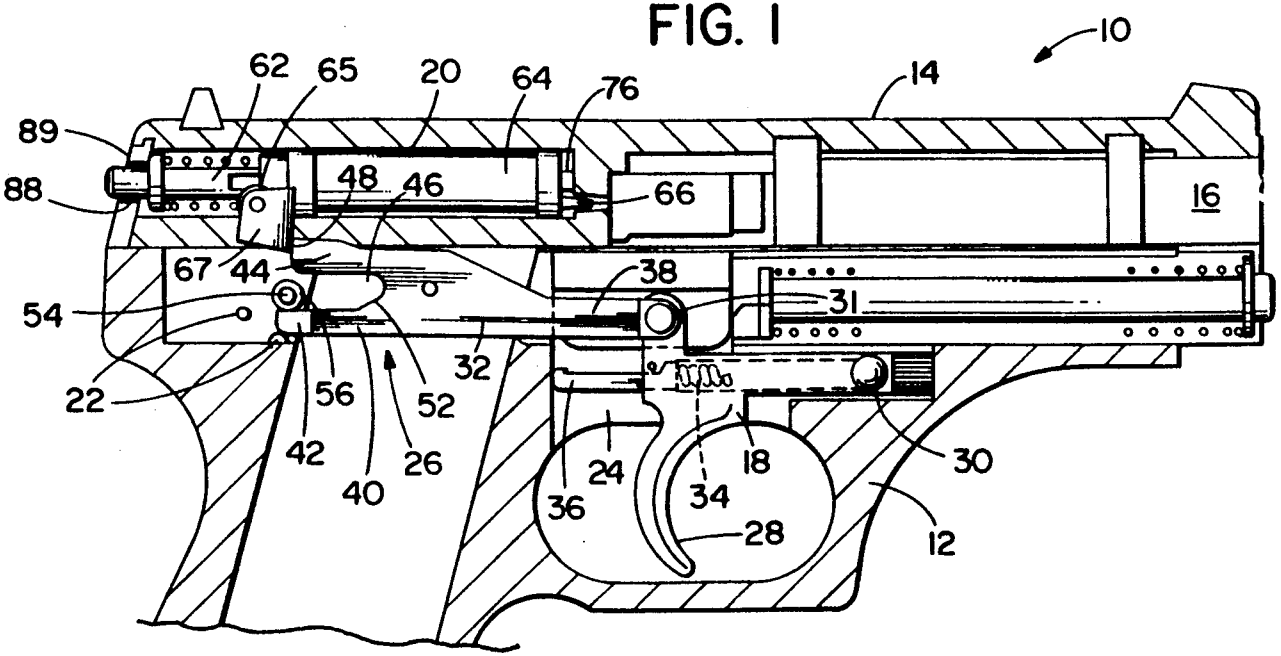
FIG. 1 is a schematic cross-sectional view of a pistol incorporating features of the present invention.

Referring to FIG. 1, there is shown a partial schematic cross-sectional view of a pistol 10 incorporating features of the present invention. Although the present invention will be described with reference to the embodiment shown in the drawings, it should be understood that the present invention can be incorporated into different types of embodiments and may be used with different types of firearms and trigger assemblies. In addition, any suitable size, shape and type of elements or materials could be used.

The pistol 10 generally comprises a frame 12, a slide 14, a barrel 16, a trigger assembly 18, and a firing pin assembly 20. The pistol 10 is similar to a pistol disclosed in U.S. patent application Ser. No. 447,601 filed Dec. 8, 1989, now U.S. Pat. No. 5,050,580 which is incorporated by reference in its entirety herein. Fixedly connected to the frame 12 and operably positioned relative to the trigger assembly 18 are sear locating or positioning plungers 22 and roller 56. The frame 12 may be comprised of any suitable material such as metal or plastic. The frame 12 has a trigger cavity 24 and a sear cavity 26. The trigger assembly 18 comprises a trigger 28, roller bearings 30 and 31, and sear 32. However, any suitable trigger assembly could be provided. The trigger 28 is movably mounted in the trigger cavity 24 for linear longitudinal movement therein supported by roller bearings 30 and 31. Spring 34 and plunger 36 bias the trigger 28 in a forward position. The sear 32 is pivotally connected to the trigger 28 proximate roller bearing 31.

The sear 32 generally comprises a first forward section 38 connected to the trigger 28 and a second rearward section 40 having a bottom leg 42, a top leg 44, and a groove 46 therebetween. However, any suitable type of sear could be provided. The top leg 44 has a sear surface 48. The bottom leg 42 has a plunger ramp on one side. The rearward section 40 also has a roller cam surface 52 in the groove 46. The sear 32 is adapted to longitudinally move with the trigger 28, but can be pivoted relative thereto proximate roller bearing 31. Fixedly mounted to the frame 12, in the sear cavity 26, is a roller pin 54 with a cam roller 56 connected thereto. The rearward section 40 of the sear 32 is operably positioned in the sear cavity 24 such that the sear 32 can move relative to the roller 56 with the roller 56 in the groove 46.

The firing pin assembly 20 has a spring unit 62, an outer case 64, a firing pin 66 at the front of the case 64, and a sear 67 fixedly connected to the case 64. A roller bearing 65 is provided on the case for moving the case relative to the frame 12 of the firearm 10. However, any suitable firing pin assembly could be provided. The sear 67 can be moved back by the sear 32 as the trigger 28 is pulled. The sear 67, in turn, can move the case 64 and firing pin 66 therewith. When the two sears 32 and 67 are disengaged from each other, at the full rear movement of the trigger 28, the spring unit 62 can propel the case 64 and firing pin 66 forward to impact upon and fire a cartridge.

Figure 2:
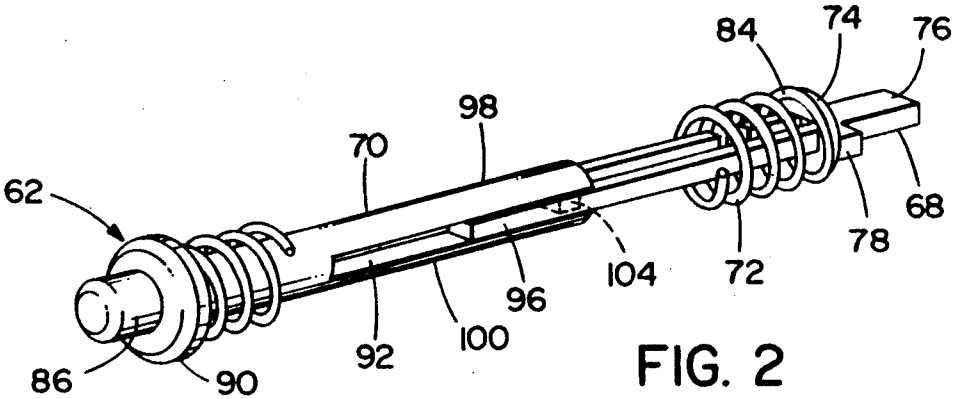
FIG. 2 is a perspective view of a firing pin spring assembly shown in the pistol of FIG. 1.
Figure 3:
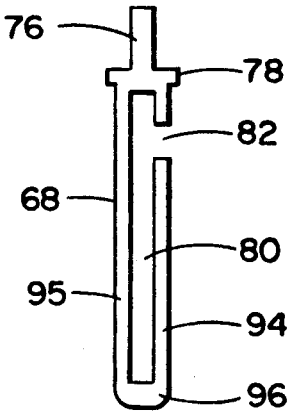
FIG. 3 is a plan top view of the front guide of the assembly shown in FIG. 2.

Referring also to FIG. 2, a perspective view of the spring unit 62 is shown. In the embodiment shown, the spring unit 62 comprises a front guide 68, a rear guide 70, a coiled spring 72, and a washer 74. The coiled spring 72 is only partially shown in FIG. 2 for purposes of clarity in showing the connection of the two guides. Referring also to FIG. 3, the front guide 68 generally comprises a single unitary member having a front extension 76, a ledge 78, a substantially enclosed elongate slot 80 therethrough, and a side aperture 82 into the slot 80. The front guide 68 is preferably made of stamped metal, but may be made of plastic or any other suitable material. The front guide slot 80 is established by side sections 94 and 95, ledge 78, and a front portion 96. Thus, the slot is substantially enclosed, except for side aperture 82 and its open top and bottom.

The front 76 of the front guide 68, in the embodiment shown, is suitably sized and shaped to project through a hole in the front of the case 64 and rest against the slide 14 as shown in FIG. 1. The front of the ledge 78 contacts the inside of the case 64. A suitable spring (not shown) biases the case 64 in its position shown in FIG. 1 with the front of the case 64 slightly spaced from the slide and the firing pin 66 slightly retracted. The back of the ledge 78 has the washer 74 thereagainst. However, the washer 74 need not be provided if the ledge 78 is sufficiently large or otherwise shaped to prevent the forward end 84 of the coil spring 72 from inadvertently getting therepast.

Figure 4:
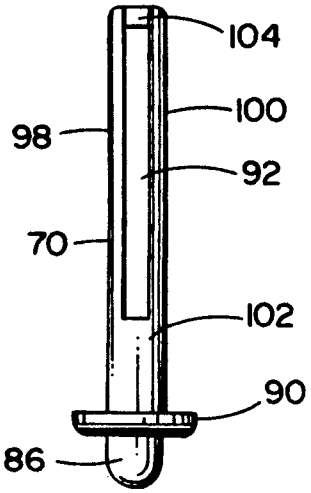
FIG. 4 is a plan side view of the rear guide of the assembly shown in FIG. 2.

Referring also to FIG. 4, a side view of the rear guide 70 is shown. The rear guide 70 is preferably made as a unitary member from suitable material such as plastic, but metal or a suitable other material could also be used. The guide 70 has a rear end 86 that is mounted in a hole 88 in a rear plate 89 mounted to the slide 14. The rear guide 70 has a spring ledge 90 and an elongate length with an elongate slot 92. The slot 92 is established by a top 98, a bottom 100, a rear 102 and a front portion 104 between the top 98 and bottom 100. The slot 92 is thus enclosed except for its two open sides. The front portion 104 is suitably sized and shaped to be movably positioned through side aperture 82 into the front guide slot 80. The height of the front guide 68 is suitably sized and shaped to be, at least partially, movably positioned in the rear guide slot 92. As shown in FIG. 2, the coiled spring 72 is compressed or preloaded between the rear guide ledge 90 and the washer 74 and ledge 78. Thus the spring 72 pushes the two guides 68 and 70 in opposite directions. With the embodiment shown, the front and rear guides 68 and 70 can be connected to each other in a telescoping fashion with the spring 72 biasing them into a limited extended position, but being compressible to allow relative movement between the guides 68 and 70 to collapse or change the length of the spring unit 62, at least temporarily.

In order to assemble the spring unit 62, the coiled spring 72 is compressed onto the rear guide 70 against the ledge 90. The washer 74 is placed on the front guide 68 adjacent the ledge 78. The front and rear guides are then connected to each other and the coiled spring 72 allowed to expand between the spring ledge 90 and washer 74. In order to connect the two guides 68 and 70 together, the front portion 104 of the rear guide 70 is passsed through the front guide 104 of the rear guide 70 is passed through the front guide side aperture 82 into the front guide slot 80. With the front portion 104 in slot 80, the rear portion 96 of the front guide 68 can be located in the rear guide slot 92. The two longitudinal slots 80 and 92 are longitudinally aligned relatively perpendicular to each other such that the front portion 96 and forward portions of the sides 94 and 95 can longitudinally move in the slot 92 and, the front portion 104 of the rear guide 70 can longitudinally move in the front guide slot 80. Thus, the two guides 68 and 70 can move relative to each other in general telescopic fashion with the front portion 104 of the rear guide 80 and rear portion 96 of the front guide 68 preventing the guides from being completely pushed apart. When the coiled spring 72 is allowed to expand between and over the two guides 68 and 70, it pushes the guides apart to an extended position wherein the front portion 104 and rear portion 96 contact each other. In a preferred embodiment, the front portion 104 has the same type of cross-sectional shape as the front guide slot 80 to help limit non-longitudinal movement of the two guides 68 and 70 relative to each other. The presence of the coiled spring 72 over the intersection of the two guides also helps to limit non-longitudinal movement of the two guides relative to each other.

Once assembled, the spring unit 62 can have the case 67 positioned thereon and be placed in the firearm 10. As the trigger 28 is pulled, the sear 32 pushes back on the sear 68 which pulls the case 64 and firing pin 66 back with the sear 67. As the case 64 is pulled back, the front guide 68 is moved back relative to the rear guide 70 as the ledge 78 is pushed by the front of the case 64. As the front guide 68 is moved back, it moves along the rear guide slot 92. In the embodiment shown, the front guide is suitably sized and shaped to be substantially entirely located in the rear guide slot 92 with the exception of a forward portion of the front guide 68. Upon the sear 32 being moved down by the roller 56 at cam surface 52, the sear 32 disengages from the sear 67. With the case 64 no longer being restrained, the coiled spring 72 pushes the washer 74, front guide 68, case 64, and firing pin 66 rapidly forward. The spring unit 62 stops expanding when the front extension 76 hits the slide 14, but the case 64 and firing pin 66 continue forward with the firing pin 66 hitting the rear of a cartridge and firing the pistol.

One of the primary features of the present invention is its ease of assembly. The unique shapes of the guides 68 and 70 allow the two guides to be connected with a limited range of travel therebetween without the need for mounting an additional retaining pin. This also prevents damage to the coiled spring that might otherwise occur during mounting of a retaining pin. This also reduced manufacturing and assembly costs of the spring unit 62. In addition, the disassembly of the spring unit 62 is much simpler than the prior art requiring only that the front end 84 of the coiled spring 72 be compressed onto the rear guide 70 and the front portion 104 of the rear guide 70 be passed through the front guide side aperture 82. The two guides 68 and 70 can thus be disconnected and the coiled spring 72 and washer 74 removed for cleaning or replacement. The use of plastic or polymer material as the rear guide 70 can also allow for a more lightweight spring unit in addition to making manufacture of the rear guide with an enclosed slot 92 easier. An obvious alternative embodiment might include the front guide not having a side aperture into its slot, but rather, the rear guide having a top or bottom aperture into its slot. Alternatively, both the front and rear guide might have apertures into their slots, but the apertures might be suitably sized and shaped such that the apertures must be aligned before the guides can be connected to or disconnected from each other. In addition, it should be understood that the references to "top", "bottom" and "side" as used above were used for the sake of descriptive clarity in describing how the two guides are connected and how they function relative to each other. The slots 80 and 92 need not be longitudinally transverse or perpendicular to each other. Other suitable types of slots or slot orientations could be devised by those skilled in the art. In addition, any suitable type of means for connecting the two guides to each other that is provided with the unitary guide members could be used.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firing pin assembly comprising:

a firing pin; and a spring assembly adapted to move said firing pin, said spring assembly having a spring, a front spring guide, and a rear spring guide, said firing pin being connected to said front spring guide for at least partial movement therewith, said spring being positioned between portions of said front and rear spring guides to bias said guides in a first extended position, said front and rear spring guides being movably connected to each other in general telescopic fashion, said front and rear spring guides each having a longitudinal slot therein with a forward portion of said rear spring guide being located in said front spring guide slot and a rearward portion of said front spring guide being located in said rear spring guide slot wherein said front and rear portions can prevent said guides from being pushed apart by said spring.

2. A firing pin assembly as in claim 1 further comprising a cylindrical case, said firing pin being connected to said case and said case being at least partially connected to said spring assembly.

3. A firing pin assembly as in claim 2 wherein said case has a sear surface connected thereto.

4. A firing pin assembly as in claim 2 wherein said case has a roller bearing connected thereto for moving said case relative to a frame of a firearm.

5. A firing pin assembly as in claim 2 wherein said case has at least a portion of said spring assembly located therein.

6. A firing pin assembly as in claim 1 wherein said front guide has a spring ledge located in front of said slot.

7. A firing pin assembly as in claim 1 wherein said longitudinal slots are generally longitudinally coaxially positioned relative to each other.

8. A firing pin assembly as in claim 7 wherein said slots are laterally transverse to each other.

9. A firing pin assembly as in claim 1 wherein said front guide has a lateral aperture into its slot.

10. A firing pin assembly as in claim 9 wherein said rear guide is a unitary member its slot is enclosed.

11. A firing pin assembly as in claim 1 wherein said front guide is suitably sized and shaped to be substantially entirely located in said rear guide slot with the exception of a forward portion of said front guide.

12. A method of manufacturing a firing pin spring assembly comprising:

providing a first spring guide, a second spring guide, and a spring, the spring guides each having a longitudinal slot therein and at least one of the guides having an opening to its slot;

positioning the spring on the first spring guide; and inserting a portion of the first spring guide into the second spring guide slot and a portion of the second spring guide into the first spring guide slot such that the portions can interfere with each other to allow limited movement of the first and second guides relative to each other.

13. A method as in claim 12 wherein the step of inserting comprises passing a front portion of the second spring guide through a lateral aperture in the first spring guide.

14. A method as in claim 12 wherein the step of inserting comprises orientating the slots generally transverse to each other.

15. A method as in claim 12 further comprising the step of allowing the spring to expand about portions of the guides and bias the guides in a first extended position relative to each other.

16. A spring assembly for use in a firearm to move a firing pin, the assembly comprising:

a first spring guide having a unitary member with a substantially enclosed longitudinal slot therein:

a second spring guide having a unitary member with an enclosed longitudinal slot therein;

a spring located between portions of said first and second guides; and means for moving said guides relative to each other in a linear path comprising said slots being substantially longitudinally coaxially positioned relative to each other and orientated transverse with each other and, portions of said guides being located in the other guide's slot to allow for a limited relative movement therebetween.

17. An assembly as in claim 16 wherein a forward portion of said second guide is located in said first guide 18. An assembly as in claim 16 further comprising means for fixedly, but removably connecting said second guide to a frame of a firearm.

19. An assembly as in claim 16 wherein said first guide has a lateral aperture into its slot.

20. A firearm spring assembly, the spring assembly comprising:

a first spring guide member having a first slot;

a second spring guide member having a second slot, the second member being movably connected to the first member with a portion of each member being located in the other member's slot; and a spring connected to the two members and biasing the two members into a predetermined position relative to each other.

* * * * *